US010422096B2

(12) United States Patent
Scuero

(10) Patent No.: US 10,422,096 B2
(45) Date of Patent: Sep. 24, 2019

(54) METHOD, WATERPROOF LINER AND WATERPROOF PANELS FOR INSTALLATION IN BASINS AND CANALS

(71) Applicant: CARPI TECH B.V., AV Berkel en Rodenrijs (NL)

(72) Inventor: Alberto Maria Scuero, Berkel en Rodenrijs (NL)

(73) Assignee: CARPI TECH B.V., Berkel en Rodenrijs (NL)

( * ) Notice: Subject to any disclaimer, the term of this patent is extended or adjusted under 35 U.S.C. 154(b) by 0 days.

(21) Appl. No.: 15/500,723

(22) PCT Filed: Jul. 30, 2015

(86) PCT No.: PCT/EP2015/067505

§ 371 (c)(1),
(2) Date: Jan. 31, 2017

(87) PCT Pub. No.: WO2016/016367

PCT Pub. Date: Feb. 4, 2016

(65) Prior Publication Data

US 2017/0218587 A1 Aug. 3, 2017

(30) Foreign Application Priority Data

Jul. 31, 2014 (IT) ..... MI2014A1393

(51) Int. Cl.
*E02B 5/00* (2006.01)
*E02B 3/12* (2006.01)
(Continued)

(52) U.S. Cl.
CPC ..... *E02B 5/02* (2013.01); *E02B 3/123* (2013.01); *E02B 3/16* (2013.01); *E02B 3/127* (2013.01)

(58) Field of Classification Search
CPC ..... A01G 25/06; E02B 11/005; E02B 11/00; E02B 13/00; E02B 5/00; E02B 5/005;
(Continued)

(56) References Cited

U.S. PATENT DOCUMENTS 2,771,745 A * 11/1956 Bramble Lloyd F ... E02B 3/126 405/270
3,474,625 A * 10/1969 Bennett Richard J ..... E02B 3/126 220/62.22

(Continued)

FOREIGN PATENT DOCUMENTS

CN 1329689 A 1/2002
DE 4221329 A1 1/1994

(Continued)

OTHER PUBLICATIONS

International Search Report & Written Opinion Application No. PCT/EP2015/067505 Completed Date: Oct. 1, 2015; dated Oct. 8, 2015 12 Pages.

*Primary Examiner* — Benjamin F Fiorello
*Assistant Examiner* — Edwin J Toledo-Duran
(74) *Attorney, Agent, or Firm* — Whitmyer IP Group LLC

(57) ABSTRACT

A method, a waterproof liner and waterproof panels for installations in basins and canals) both dry and with stationary and flowing water. The liner consists of a plurality of prefabricated panels, including at least one flexible waterproof membrane, made of geosynthetic material, provided with side anchor bands for anchoring to the ground and with side sealing flaps. The panels that are rolled up into rolls are sequentially unrolled and extended by fixing provisionally along at least one anchor band, by joining simultaneously the flaps of adjoining panels by means of an intermediate zip fastener. Subsequently, the individual panels are firmly anchored by friction to the bottom and/or to the banks of the
(Continued)

basin or canal, by means of a permanent ballast. The individual panels can be removed and replaced by operating underwater, restoring the seal between panels of the entire waterproof liner.

32 Claims, 10 Drawing Sheets

(51) Int. Cl.
*E02B 5/02* (2006.01)
*E02B 3/16* (2006.01)

(58) Field of Classification Search
CPC ... E02B 5/02; E02B 3/16; E02B 3/123; E02B 3/127; E01C 13/06; E03F 1/003
USPC ... 405/118, 119, 121, 43, 44, 45, 46, 47, 49, 405/129.45, 129.6, 129.75
See application file for complete search history.

(56) References Cited

U.S. PATENT DOCUMENTS 3,538,711 A * 11/1970 Nielsen ..... E02B 3/06 405/23
3,563,037 A * 2/1971 QUERY ..... E02B 3/126 139/384 R
3,736,754 A * 6/1973 Azalbert ..... B65D 88/76 405/53
3,854,292 A * 12/1974 Nienstadt ..... E02B 5/02 405/270
4,102,137 A * 7/1978 Porraz ..... E02B 3/127 405/172
4,357,377 A * 11/1982 Yamamoto ..... B32B 11/02 428/40.3
4,488,338 A * 12/1984 Takahashi ..... A44B 19/32 24/389
4,513,482 A * 4/1985 Fukuroi ..... A44B 19/32 24/384
4,659,252 A * 4/1987 Sexton ..... E02B 7/02 405/107
4,690,585 A * 9/1987 Holmberg ..... E02B 3/127 405/15
4,804,293 A * 2/1989 Varkonyi ..... E02B 3/126 405/15
4,913,583 A * 4/1990 Ledeuil ..... E02B 3/16 405/107
4,940,364 A * 7/1990 Dlugosz ..... E01C 3/006 405/129.6
4,966,492 A * 10/1990 Poyda ..... E02D 31/004 405/129.5
5,017,042 A * 5/1991 Minor ..... E02B 11/00 405/36
5,056,960 A * 10/1991 Marienfeld ..... B09B 1/00 405/129.6
5,082,397 A * 1/1992 Raviv ..... E02B 3/16 405/176
5,374,139 A * 12/1994 Kugler ..... B09B 1/00 405/129.6
5,662,983 A * 9/1997 Stark ..... B09B 1/00 428/117
5,720,576 A * 2/1998 Scuero ..... E02B 7/08 405/116
5,806,252 A * 9/1998 Scuero ..... E02B 5/02 405/268
5,906,454 A * 5/1999 Medico, Jr. ..... E01C 7/30 404/32
6,102,613 A * 8/2000 Medico, Jr. ..... E01C 5/18 404/17
6,368,017 B2 * 4/2002 Black ..... E02D 29/0208 210/170.03
6,484,473 B1 * 11/2002 Hall ..... E01C 3/006 405/17
6,505,996 B1 * 1/2003 Ianniello ..... E01F 5/00 404/2
6,755,596 B2 * 6/2004 Schibi ..... E02B 5/02 405/270
6,857,818 B2 * 2/2005 Bussey, Jr. ..... E02B 11/005 405/36
7,488,523 B1 * 2/2009 Muncaster ..... B32B 11/04 404/17
7,686,903 B2 * 3/2010 Muncaster ..... B32B 11/04 156/247
8,287,982 B2 * 10/2012 Brewin ..... D04B 21/16 428/86
2005/0050697 A1 * 3/2005 Wu ..... A44B 19/32 24/389
2006/0002764 A1 * 1/2006 Legge ..... E02D 31/004 405/129.57
2011/0154775 A1 6/2011 Jutras
2015/0104257 A1 * 4/2015 Cooley ..... E02B 3/126 405/17

FOREIGN PATENT DOCUMENTS

DE 4405523 A1 8/1995
EP 0491454 A1 6/1992
EP 1141490 A1 10/2001
GB 1111453 A 4/1968
WO 8101719 A1 6/1981
WO 2005087488 A2 9/2005
WO 2012049269 A1 4/2012
WO 2013042147 A1 3/2013

* cited by examiner

METHOD, WATERPROOF LINER AND WATERPROOF PANELS FOR INSTALLATION IN BASINS AND CANALS

CROSS REFERENCE TO RELATED APPLICATIONS

This application is a national phase of PCT International Application No. PCT/EP2015/067505 filed Jul. 30, 2015. PCT/EP2015/067505 claims priority to IT Application No. MI2014A001393 filed Jul. 31, 2014. The entire contents of these applications are incorporated herein by reference.

TECHNICAL FIELD

The present invention relates to a method, a waterproof liner and to waterproof panels that are suitable for installation in basins and canals, both with running water and with stationary water or water subject to waves, not excluding a dry installation, depending on different design needs.

BACKGROUND

In particular, the invention relates to a method for both dry and underwater installation of a waterproof liner that is suitable for preventing both ground erosion and leaks of water caused by seepage through the bottom and/or side banks, in hydraulic canals, irrigation canals or in basins for collecting water.

As is known, the bottom and the side banks of canals for conveying water, or of collecting basins, often have to be protected by a suitable waterproof liner, to prevent both ground erosion, and loss of water through seepage through the bottom and the side banks.

In the past the bottom and the sides of a canal were lined by laying a plurality of concrete slabs next to one another and subsequently sealing the joints between slabs with cement or joining elements for example waterstop.

Nevertheless, the concrete slabs had to be laid dry, in the absence of water in the canal; in case for example of hydraulic canals intended to serve several installations or intended for irrigation, the need to operate dry involved interrupting the flow of water and the services for which the canals were intended.

Further, the concrete slabs are subject to cracking and splitting, and sometimes have a high degree of permeability with consequent losses of water through seepage through the concrete and the splits or defective joints thereof. Using concrete slabs also entails onerous conveying and installation operations, depending on the conformation of the ground, with high costs and excessively long laying times; experience has thus shown that the use of concrete slabs entails numerous problems.

In an attempt to improve the degree of waterproof, in addition to simplifying the operations of laying the waterproof liner, the use of glass fibre panels or of panels of another material has been proposed that are covered with a resin, and are fixed by anchoring, as disclosed for example in U.S. Pat. Nos. 3,854,292, 5,806,252 and US 2002/0094238. Nevertheless, also these solutions entail the need to lay the waterproof liner only dry and to perform maintenance operations; with a consequent interruption to the flow of water.

In the past, the use of waterproof panels comprising a layer of clay was also proposed, for example a bentonite mixture in powder or granules, in which the layer of clay is confined between two textile containing layers, for example a geotextile, which are necessary to enable the bentonite to be wetted, and in which the layers of textile are joined by tie rods or intermediate connecting members configured for maintaining the two layers of textile at a suitable distance during swelling of the bentonite caused by wetting. In fact, during the wetting process, the particles of clay tend to expand, gradually reducing the passage and seepage of water into the underlying ground. Nevertheless, the use of waterproof panels comprising a layer of bentonite, confined between two layers of textile, does not permit the quality and thickness of the entire panel to be controlled; it also has a relatively high permeability coefficient, unless complex and costly formulations are resorted to, and also entails the release of polluting substances contained in the bentonite mixture, through the layers of containing textile, which are not watertight.

It is also known that the behaviour of the bentonite depends on the mineral components and on the chemical and physical properties thereof; accordingly, the degree of permeability of the bentonite is difficult to control because it is subject to variations with temperature and of the bentonite mixture.

Using the waterproof panels in bentonite thus makes it difficult to maintain the degree of permeability at a low, substantially constant and controlled value; it also always requires the waterproof liner to be laid and formed in the absence of water in the canal or basin.

Waterproof bentonite panels are disclosed, for example, in EP 0491454, EP 1141490, DE 4221329 and DE 4405523.

In particular, EP 0491454 relates to a waterproof panel comprising an intermediate bentonite granular layer, confined between two layers of textile that are structurally interconnected by means of filaments by perforating the bentonite layer to interconnect the fibres of the two layers of textile over the entire surface of the panel.

EP1141490 in turn relates to a waterproof mat, which again comprises a lower support layer and an upper cover layer of fabric or film of plastics, with connecting elements that traverse an intermediate bentonite layer, in which the lower support layer is provided with an adhesive, which is insoluble in water, covered with grains of sand that are suitable for providing great static friction with the ground.

DE 4221329 also relates to a waterproof mat comprising a bentonite layer confined between two containing layers joined by parallel seams suitable for forming tubular cells, in which the upper layer is provided with slits that are suitable for enabling the bentonite to exit partially.

Lastly, DE 4405523 also relates to a waterproof mat consisting of a double fabric filled with sand, bentonite or concrete, in which the side edges of the mat are configured so as to permit simple superimposing of the edges of two adjoining mats.

Using bentonite panels or mats is inadvisable not only because bentonite does not permit suitable control of the degree of permeability of the panel or mat, in addition to the need to work in the absence of water in the canal or basin, but the porous nature of the two layers confining the bentonite, or the presence of slits entails possible pollution of the water that flows along the canal or that is contained in the collecting basin; further, in addition to the need to install the liner on the bottom and/or the banks of the canal or basin only dry, in the absence of water, the use of bentonite or cementitious mixtures envisaged for performing the dual function of waterproof and ballasting the waterproof liner does not permit appropriate and homogeneous waterproof, being also critical in the case of splitting of the bentonite or concrete layer, in particular, between joints of adjoining panels.

It has also been proposed to construct a liner, both in the presence of running water and waves, for the sole purpose of reducing the phenomenon of ground erosion. Examples of liners installed directly underwater are found in GB 1111453, U.S. Pat. No. 3,538,711, WO 8101719 and U.S. Pat. No. 5,720,576.

In particular, GB 1111453 illustrates a method for constructing a protective liner underwater, substantially consisting of individual panels comprising two superimposed layers of flexible material, between which a cementitious, asphalt or other material that is suitable for forming a ballast is injected; the panel is further configured with a plurality of interconnecting areas between containing layers of the ballast material, in which openings are formed at the joining points, so as to prevent the panel moving away or breaking because of the sucking action of the flow of water or of the hydrostatic pressure of the water in the ground. Again, a protective panel is proposed for the sole purpose of preventing or limiting the erosion of the underlying ground, which is completely unsuitable for providing waterproof.

U.S. Pat. No. 3,538,711 in turn proposes using ballasted panels for controlling and preventing coastal erosion which substantially consist of a long flexible tubular element, formed of plastic sheets welded along the edges, or of fabric that is filled with sand or small stones; tubular elements are simply positioned side by side, or superimposed, to protect a preset area.

WO 8101719 discloses in turn the use of long tubular elements made of plastics that are filled with concrete during laying underwater, the elements being laid on the bottom with the help of a diver. Also this solution, like the preceding solutions, does not permit total waterproof of areas of large dimensions, being again critical in the event of cracks or splitting of the tubular element at joining points; it further makes it impossible to replace and/or repair the tubular elements underwater.

In U.S. Pat. No. 5,720,576, lastly, it has been proposed to use waterproof membranes made of polymer or geosynthetic material, more commonly known as "geomembranes" to waterproof dams or hydraulic structures in which the membranes are sealingly connected, by superimposing and clamping the edges by means of metal sections anchored to the hydraulic structure; such a solution, in addition to being extremely complex and costly, requires a comparatively long laying time, being completely unsuitable for laying underwater waterproof liners in canals or in the presence of running water.

WO2012040269 discloses a method and a device for draining off water seeped in a soil underlying a hydraulic structure, such as a canal, basin, dams and the like. A liner, consisting of a geomembrane constituted by a plurality of waterproof sheets, is laid on the bottom wall and side walls of the hydraulic structure, by providing the liner with one-way gravity drainage valves which extend longitudinally with respect to the lateral walls or the bottom wall of the hydraulic structure. The edges of adjacent panels are superimposed and may be welded together to form said valves; therefore it is not sure that, in the presence of negative pressures, water contained in the hydraulic structure is unable to seep under the waterproof liner, in the regions where the edges of adjacent panels are superimposed. The waterproof liner is anchored to the bottom and to the walls of the channel by placing concrete slabs over the covering.

In general, the prior art has thus provided to protect canals or waterways from the corrosion of the ground and/or of the side banks, i.e. to form a waterproof liner by layers of bentonite material confined between layers that are permeable to water to enable the bentonite to expand in a controllable manner only partially. It has also been proposed to protect the bottom and the banks of canals by panels placed underwater, formed at the moment of placing thereof, by means of complex apparatuses.

Previously proposed methods and systems for laying liners in addition to requiring comparatively long and costly procedures, in particular, in the case of bentonite panels, do not permit constant control of the degree of permeability. None of the preceding cases thus permits a complete adequate seal of the entire waterproof liner, in particular, in the zones joining adjoining panels, or the possibility of intervening subsequently for performing repair and maintenance works underwater, or repairing and/or replacing individual damaged panels by operating always in the presence of water to restore the entire seal of the waterproof liner; further, it is not possible to connect to existing structures so as to ensure the impermeability thereof.

There accordingly exists the need to find a new solution for installing and laying underwater, in canals and basins, a waterproof liner comprising a plurality of panels that are alongside one another, that enables the various panels to be sealingly connected directly during laying underwater, so as to reduce significantly the time and cost of laying the entire liner, also permitting close control of the quality of the work and a high degree of waterproof.

SUMMARY

The main object of the present invention is thus to provide a method for installing and laying underwater a waterproof liner in canals and basins also in the presence of running water or of stationary water, by means of which it is possible to achieve, in a controlled manner, a high degree of waterproof, thereby minimising water loss through seepage into the underlying ground.

A further object of the invention is to provide a method for installing and laying underwater a waterproof liner that does not require lengthy operations on site, permitting easy installation of the liner in a short time and at comparatively low cost.

A further object of the invention is to provide a method for installing and laying underwater a waterproof liner, as mentioned above, by means of which constant control of the degree of permeability of the liner is made possible, both during laying and subsequently, enabling repair and/or replacement of the individual panels to be performed underwater and the waterproof conditions of the entire liner to be restored.

A still further object is to provide a waterproof liner for canals and basins of water by means of the method mentioned above, having a very low degree of permeability, high resistance to stresses and to hydraulic pressure, being easy and rapid to install, repairability in the case of breakage or damage, and which does not require particular maintenance after installation, eliminating any cause of pollution during laying and afterwards.

A further object of the invention is to provide a method and a waterproof liner, as mentioned, by means of which it is possible to restore the bottom and/or the banks of canals or of existing hydraulic works, by a plurality of waterproof panels in which, unlike conventional systems, the waterproof is permitted by the use of suitably shaped waterproof geomembranes in which the cementitious material used performs only the function of ballast or anchoring and not waterproof and anti-erosion. It does not therefore require the use of particular cementitious mixtures and of a high cost; further, laying the liner underwater is achieved by a mechanical seal connection between adjoining panels, and total anchoring and settling independence of the panels to the bottom and/or to the banks of any hydraulic work to be lined. Although geomembrane technology has been available for a long time, until now it has not been possible to find an ideal solution for suitable use of geomembranes for the previously mentioned purposes.

The above objects are thus achievable by a method according to claim 1, respectively by means of a waterproof liner according to claim 18, and by means of a waterproof panel according to claim 27.

According to a first aspect of the invention, a method is thus provided for installing and laying a waterproof liner, on the bottom and/or on the side banks of a canal or water basin, comprising the steps of:

manufacturing a plurality of waterproof panels, in which each panel comprises at least one waterproof membrane made of geosynthetic material, having side anchor bands and sealing flexible flaps, which extend on opposite edges of the panel;

sequentially positioning a number of waterproof panels, on the bottom and/or on the side banks of the canal or water basin;

fastening in advance to the bottom and/or to the side banks at least one side anchor band during laying of each panel;

disengageably connecting opposite side sealing flaps of the adjoining waterproof panels by a watertight jointing device; and frictionally anchoring, by ballast, each waterproof panel to the bottom and/or against the side banks of the canal or water basin.

For example, the panels are laid by unrolling the panels underwater, anchoring and sealing between panels being achieved during laying.

According to another aspect of the invention, a waterproof panel has been provided that is suitable for underwater installing and laying by means of the method mentioned above, comprising:

a plurality of independent waterproof panels positioned side by side, that extend on the bottom and/or on side banks of the canal or water basin;

in which each panel is provided, along longitudinal or transverse edges, with flexible anchor bands and with sealing flexible flaps;

in which at least one anchor band of each waterproof panel is fixed to the bottom and/or to the side banks of the canal or water basin, in which a watertight device is interposed between opposite sealing flaps of adjoining panels; and in which a permanent ballast is provided for each waterproof panel, the ballast being configured and positioned for pushing and frictionally anchoring the panel against the bottom and/or against the side banks of the canal or of the water basin.

According to still another aspect of the invention a waterproof panel has been provided that is suitable for installing underwater a liner for canals or water basins as mentioned above, in which the panel comprises:

at least one waterproof membrane made of geosynthetic material configured with a flexible anchor band and a sealing flexible flap along longitudinal and/or transverse edges; and a jointing member, along each sealing flexible flap of the panel, configured for providing a watertight joint between opposite flexible flaps of the adjoining panels.

BRIEF DESCRIPTION OF THE DRAWINGS

These and further features of the method, of the waterproof liner and some embodiments of waterproof panels according to the invention will be illustrated below with reference to the drawings, in which.

DETAILED DESCRIPTION

With reference to FIGS. 1 to 5, a first embodiment of a waterproof panel will be disclosed that is suitable for the installing and laying down dry or underwater of a waterproof liner in a canal; obviously, what will be said below with reference to both FIGS. 1 to 5 and to the subsequent figures must not be understood restrictively with regard to the conformation and laying of the waterproof panels; in fact, the waterproof panels, in the shown conformation or in any other equivalent conformation, can be used to form waterproof liners in any type of hydraulic canal, for irrigation, or for any hydraulic application different from the one shown.

Lastly, it is pointed out that in some figures the same reference numbers will be used, with the possible addition of an index, to indicate similar or equivalent parts.

Figure 1:
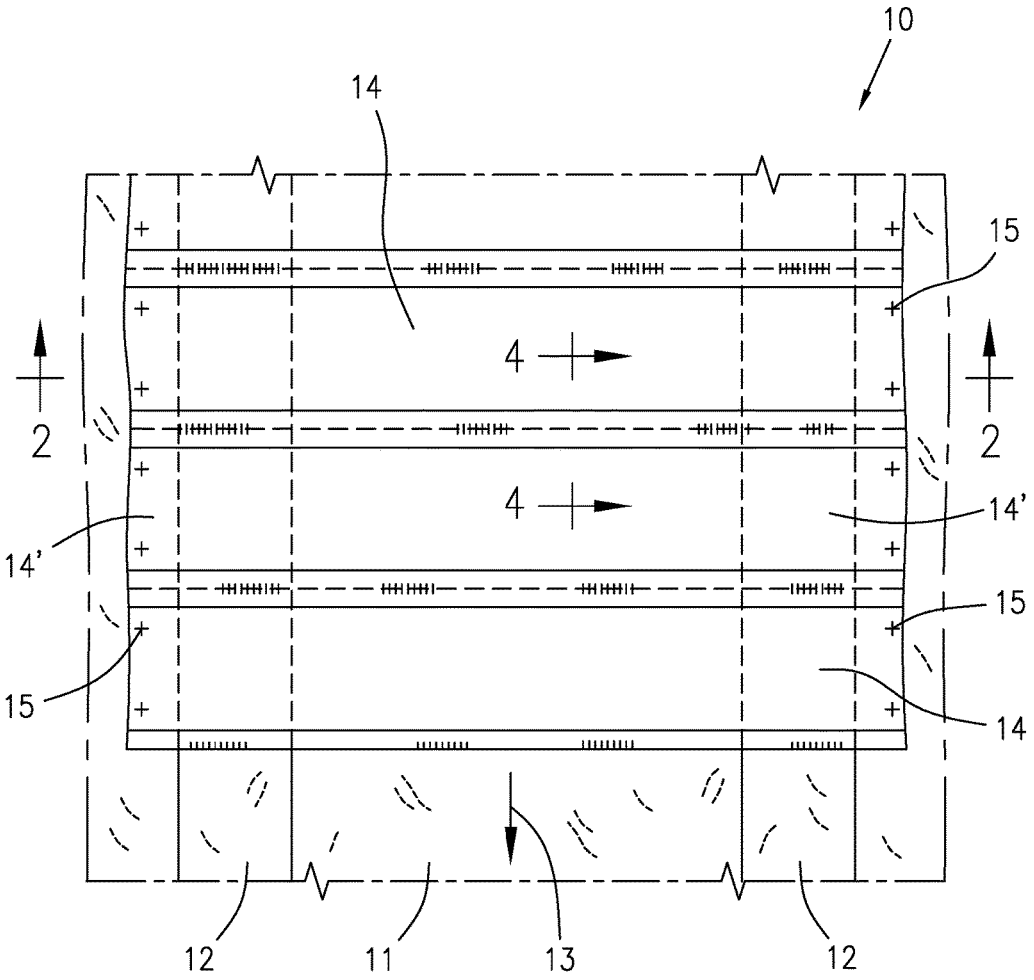
FIG. 1 is a top view of a portion of a canal of water, provided with a waterproof liner according to the invention.
Figure 2:
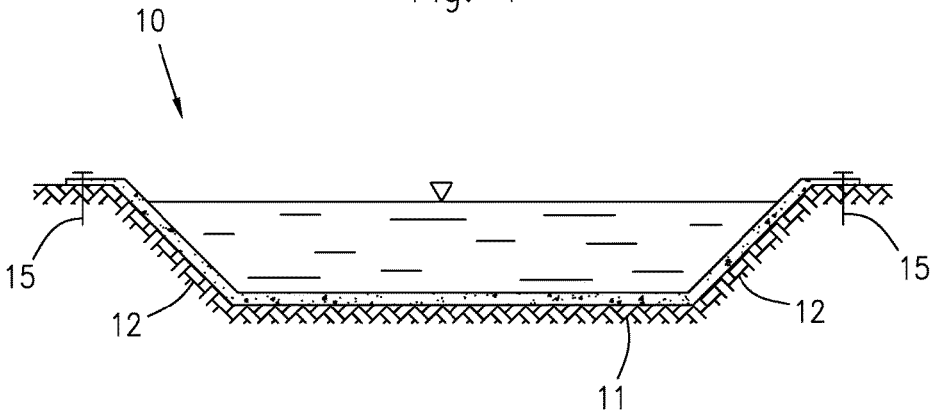
FIG. 2 is a cross section, according to line 2-2 of FIG. 1.

In FIGS. 1 and 2 a top view is shown of respectively a cross section, of a portion of a hydraulic canal or irrigation canal; the canal, which is indicated overall with 10, comprises a bottom 11 and two side banks 12 for conveying a flow of water in the direction of the arrow 13, which, according to the flow regime, can have a higher or lower level that the level shown, both over time and along the canal.

With the reference number 14 individual waterproof panels have been indicated that overall constitute the waterproof liner according to the invention.

As during underwater installing and laying of the waterproof panels 14, in the case of the canal 10 the flow of water can have a speed that is variable over time, that can be, locally, for example, a speed that is the same as or greater than 0.5 m/s, and as the canal 10 can have a considerable length, of the order of tens or hundreds of kilometers, the individual waterproof panels 14 have to be configured and a laying method has to be defined that are such as to enable waterproof panels to be manufactured beforehand in the factory such panels having constant waterproof and structural features that are closely checkable; it is also necessary for the individual panels 14 to be configured in such a way as to permit laying with simple methods so as to reduce significantly both the cost and time of installing and/or anchoring the waterproof liner along an affected portion of canal or in any water basin or hydraulic structure. Lastly, with the reference number 15 stakes have been indicated for fixing the two ends 14' of each waterproof panel 14 to the two banks 12 of the canal 10.

Figure 3:
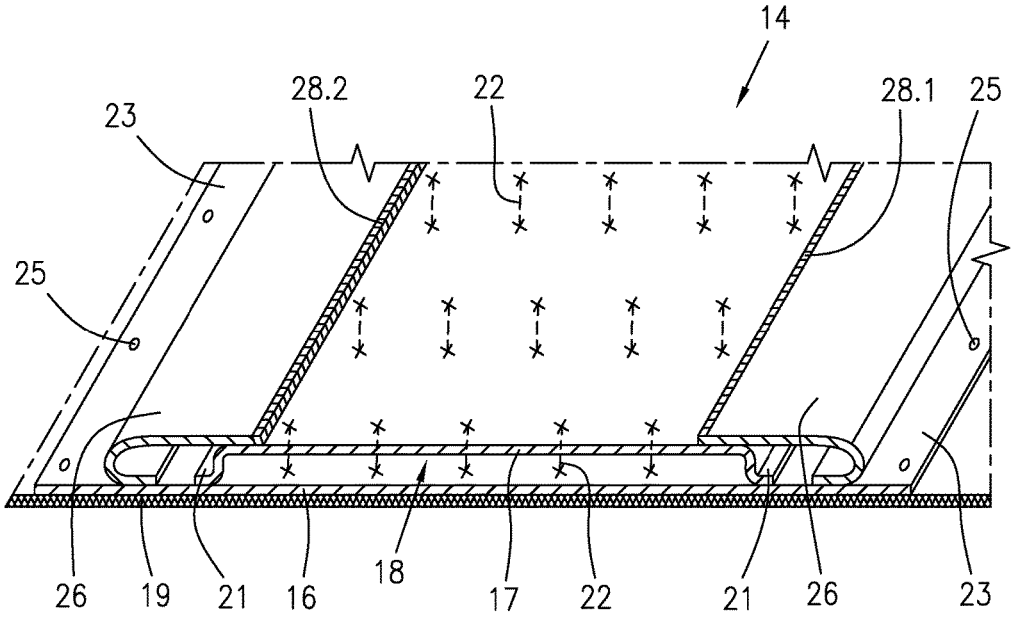
FIG. 3 is an enlarged cross section of a first embodiment of a waterproof panel according to the present invention.
Figure 4:
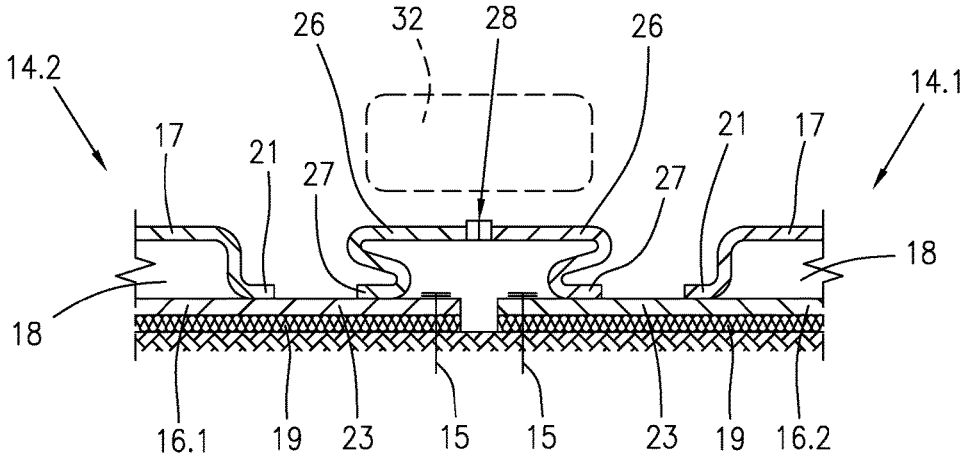
FIG. 4 is an enlarged cross section of a first solution of a waterproof joint between panels of FIG. 3, according to line 4-4 of FIG. 1.
Figure 5:
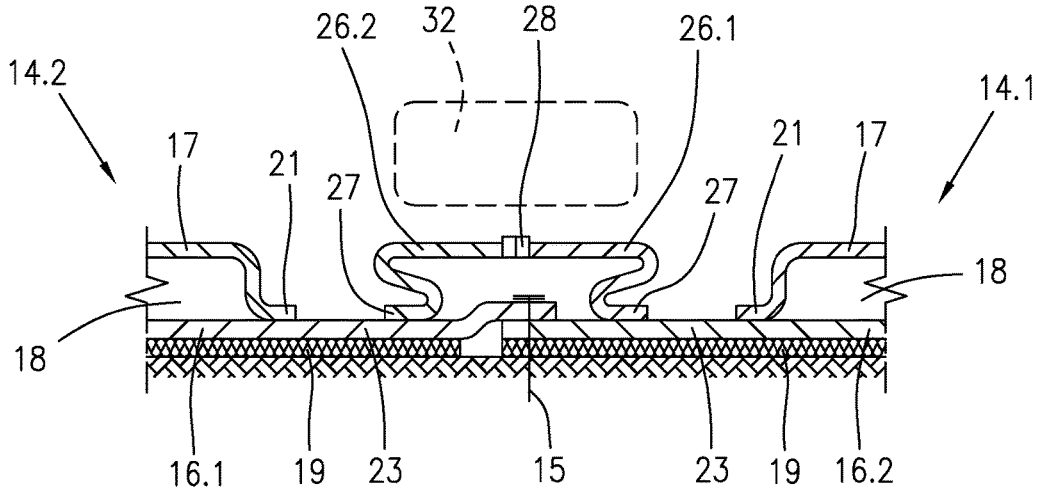
FIG. 5 is a cross section similar to the cross section of FIG. 4 of a second solution.

With reference now to FIGS. 3 to 5 a first embodiment of a waterproof panel 14 according to the present invention will be disclosed. As shown in FIG. 3, the panel 14 comprises a lower waterproof membrane 16, consisting of a geomembrane, and an upper waterproof membrane 17, joined in a watertight manner along the peripheral edges, defining a tubular chamber 18 of any desired length or width. In the case shown, the panel 14 has a rectangular shape that extends longitudinally over the entire width of the canal 10; nevertheless, the panel 14 could have any other shape and/or dimension that are different from those shown.

The lower membrane 16 and/or the upper membrane 17 can be made of any geosynthetic material that is suitable for forming an efficient barrier to water.

The lower membrane 16 material or upper membrane 17 material can consist of a waterproof membrane in PVC or other synthetic resin, for example a geomembrane SIBELON CNT™ having a thickness comprised between 1 and 5 mm, and a low permeability coefficient K according to the law of Darcy, for example a coefficient K that is equal to or lower than $10^{-10}$ cm/s. The membrane 16 is coupled with a geotextile layer 19 that is suitable for contact with the ground, configured for providing protection against perforation and a suitable friction coefficient against the ground.

The use of a synthetic resin geomembrane having a low permeability coefficient K, in the prefabrication of waterproof panels according to the present invention, with respect to waterproof panels in bentonite or of another type, proves to be extremely suitable as it enables a very high degree of waterproof to be obtained, and constant and accurate control of the structural waterproof features thereof, which in this manner remain substantially constant over the entire lining to be made, regardless of the type and of the features of the ballast that will be used to anchor the individual panels to the bottom and/or to the banks of a canal or water basin.

Otherwise, the upper sheet material 17, which has mainly the function of confining and covering the ballast that will be injected into the chamber 18, can be made of any watertight material, at low cost, for example of geomembrane of lesser thickness than that of the bottom geomembrane 16, or can consist of any textile material that is coated or provided with a waterproof layer of PVC or another suitable synthetic resin that is compatible with the synthetic resin of the bottom membrane 16, to enable the two layers to be sealingly welded together. As previously mentioned, one or both the waterproof membranes 16 and 17 can consist of a geosynthetic material of suitable thickness; it is nevertheless possible that one of the two waterproof membranes 16 and 17 consists of a geosynthetic material. In certain cases the upper waterproof membrane, intended to come into contact with the moving flow of water, is made of geosynthetic material that is suitable for providing both the necessary waterproof of the panel 14 and relatively low roughness. In this manner, not only are possible repair works to a damaged geomembrane made possible, without removing the waterproof panel, but also greater flow speed and flow rate of a canal are permitted.

In the case shown, the upper covering sheet 17 is sealingly welded to the lower membrane 17 along the longitudinal edges 21, leaving the two ends 14' of the panel open, which can in turn be sealingly welded as explained further on, providing suitable air venting valves or openings at the ends 14' of the panel.

In positions that are intermediate to the two membranes 16 or 17, there are a number of tie rods or spacers 22, for example consisting of a technical yarn, which have the function of maintaining the two membranes 16, 17 correctly spaced apart from one another when the tubular chamber 18 is filled with a suitable quantity of a ballast material.

In the case shown in FIG. 3, the tie rods 22 have been schematically indicated in the form of textile yarns that are suitable fixed to the two membranes 16 and 17 along connecting lines that are parallel to one another, that extend longitudinally and/or transversely to the panel; the tie rods 22 can have any length, for example comprised between 10 cm and 20 cm, and any pitch or distance between rows, comprised for example between 10 cm and 30 cm; nevertheless, the tie rods 22 could be otherwise configured and/or arranged, as shown in the examples of the figures that follow.

A panel 14 that is thus formed takes the shape of a large flat sack having a length, for example, of a few tenths of a meter, which can be easily prefabricated and rolled up for storage and transport, then be subsequently unwrapped for laying and ballasted as explained below. The flat shape of the lower side constituted by the membrane 16, and the flexibility of the membrane promote the adhesion of the panel to the bottom and to the side banks of the canal or water basin to be waterproofed, adapting correctly to the conformation of the underlying ground; otherwise, the flat shape of the upper side of the panel 14 constituted by the sheet 17, if the panel is used to line the bottom and the banks of a canal, as previously mentioned, tends to promote the flowing of the flow of water, reducing loss through friction, thus helping to increase the flow rate of the canal.

FIGS. 3 and 4 show an innovative feature of the waterproof panel 14 according to the invention, that is suitable for enabling a mechanical seal connection between longitudinal edges of adjoining panels, maintaining the panels structurally and functionally independent of one another, i.e. able to be easily removed if damaged and be replaced with a new panel, restoring the continuity and seal of the waterproof liner. In fact, as can be seen from the aforesaid figures, the lower membrane 16 has a central part, comprised between the two welding lines 21 of the upper membrane 17; the panel 14 on at least one side further comprises a flexible side band 23, also known as an anchor band, that extends longitudinally over the entire length or width of the panel 14.

The side anchor band or bands 23, as explained below, are used for preliminary anchoring of the panels, for example by means of stakes 15, during laying underwater. The anchor bands 23 can be shaped in any manner; for example in the case shown they consist of an extension of the side edges of the lower membrane 16, beyond the welding line 21 of the upper sheet 17, for a preset width. The anchor bands 23 can be further configured with a series of holes 25 for inserting the anchor stakes 15.

The panel 14, in addition to the anchor band or bands 23, has on each longitudinal side a flexible flap or sealing flap 26 welded in 27 to the lower anchor band 23 near the weld 21 between the waterproof membrane 16 and the upper waterproof membrane 17.

In the embodiment shown in FIG. 3, each of the two sealing flaps 26 is provided with a variably configured watertight jointing device 28; further, the two sealing flaps 26 have a greater width than the width of the anchor bands 23, protruding laterally from the latter so as to form a slack intermediate zone when the facing sealing flaps 26 of two adjoining panels 14 are sealingly connected together as shown in FIG. 4. The conformation and the width of the sealing flaps 26, which are such as to form an intermediate slack zone, enables possible misalignments between adjoining panels 14 to be compensated during laying, enabling in this manner a sealing connection of the joint 28 even if the edges of the flaps 26 of two adjoining panels 14 are not perfectly parallel to one another.

Figure 6:
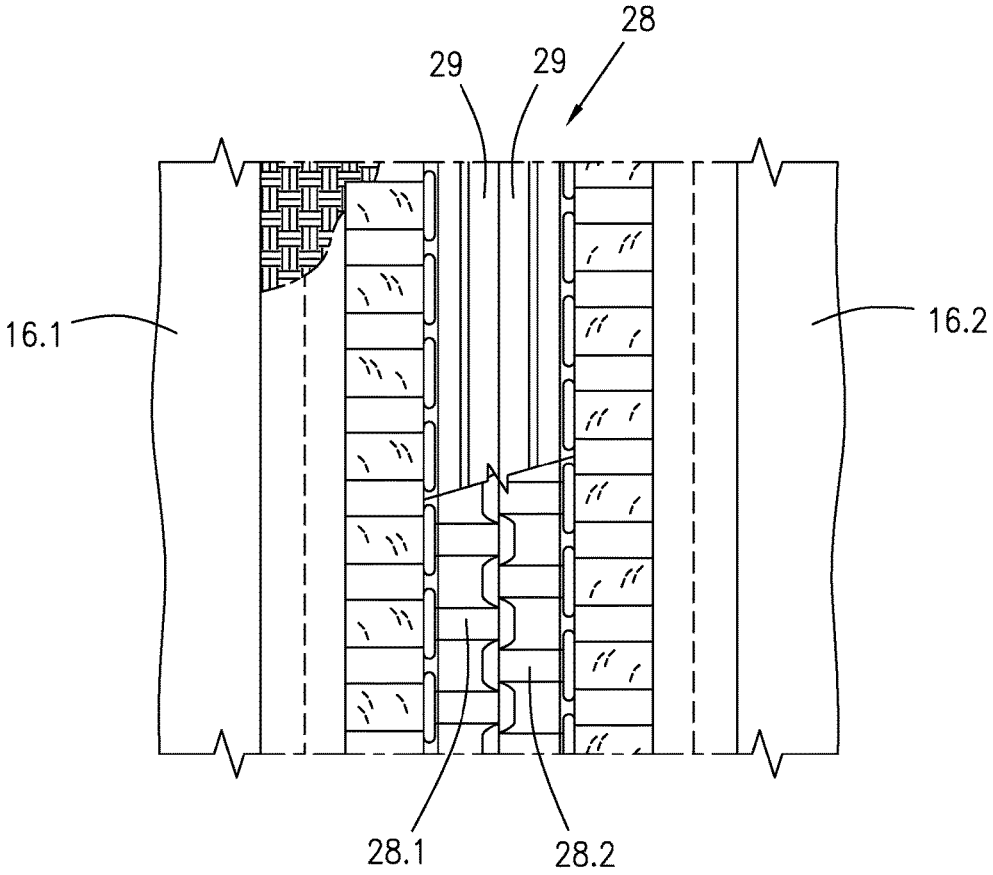
FIG. 6 is an enlarged detail, top viewed, of the joint in FIG. 4 comprising a watertight zip fastener.

The watertight joint 28 can be configured in any manner; a solution is shown in the embodiment of FIGS. 4 and 6, in which use is made of a watertight zip fastener for the joint 28; as shown, the zip fastener 28 comprises a first toothed strip 28.1, welded along an edge of one of the sealing flaps 26.1 of a first panel 14.1, and a second toothed strip 28.2 welded to the sealing flap 26.2 of an adjoining panel 14.2 opposite the preceding one, provided with a suitable cursor, which is not shown, for coupling and disengaging the two toothed strips 28.1 and 28.2 of the zip fastener, in a per se known manner; suitable washers 29 permit waterproof closure of the zip fastener.

Waterproof zip fasteners are generally known, for example from U.S. Pat. No. 4,513,482 and from U.S. Pat. No. 4,488,338 for various civil uses; nevertheless, the use of a waterproof zip fastener, for this specific application, in addition to being extremely practical and suitable, is also extremely innovative because it enables the flaps 26 of two adjoining panels 14 to be sealingly joined directly during underwater laying thereof, maintaining the structural and functional independence of the panels; in this manner the operations of laying the panels 14 and of both dry and underwater installation of the waterproof liner are enormously simplified and performed in an extremely short time. Further, the use of zip fasteners or of equivalent disengageable sealing devices enables a damaged panel 14 to be removed and replaced easily, with another new waterproof panel 14, always operating extremely rapidly, without interrupting the flow of water into the canal or emptying the water basin.

FIG. 5 shows a version of FIG. 4, in which the opposite edges of the two anchor bands 23 have been partially superimposed, being fixed by means of stakes 15; for all the rest the solution of FIG. 5 corresponds to the solution of FIG. 4, so the same reference numbers have been used to indicate similar or equivalent parts.

The advantages that are intrinsic to the system according to the invention for installing and laying a waterproof liner constituted by a plurality of independent panels 14, that adjoin one another and are sealing connected, that extend transversely to a canal or to a water basin, against the bottom and/or on the opposite banks, consist of:

a) the possibility of prefabricating the panels 14 in a constantly controlled manner, i.e. having identical structural and waterproof characteristics of the individual panels;

b) the possibility of forming waterproof liners on canals and/or water basins of great extent, maintaining waterproof features for the entire liner that are substantially constant and controlled during laying, that are completely independent of the ground morphological conditions and climatic conditions of the place of installation;

c) further, as the individual waterproof panels 14 can be made in a controlled manner with flexible sheet material, upon completion of manufacture in the factory of the panels the latter can be rolled up into a roll, stored and sent to the place of laying, and be subsequently installed by unrolling directly underwater, automatically joining sealingly the panels by suitable equipment, which are then suitably ballasted and frictionally anchored to the bottom and to the banks of a canal or water basin.

Figure 7:
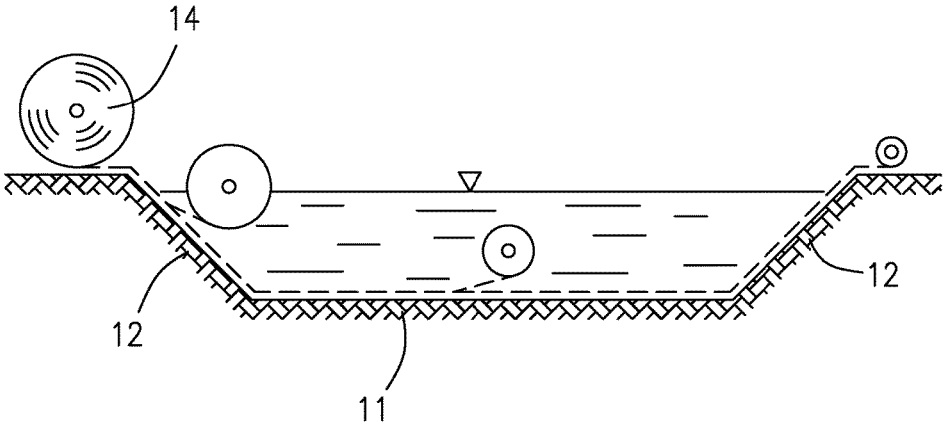
FIG. 7 shows, schematically, the immersion and the laying underwater of a waterproof panel in the canal of FIG. 1.
Figure 8:
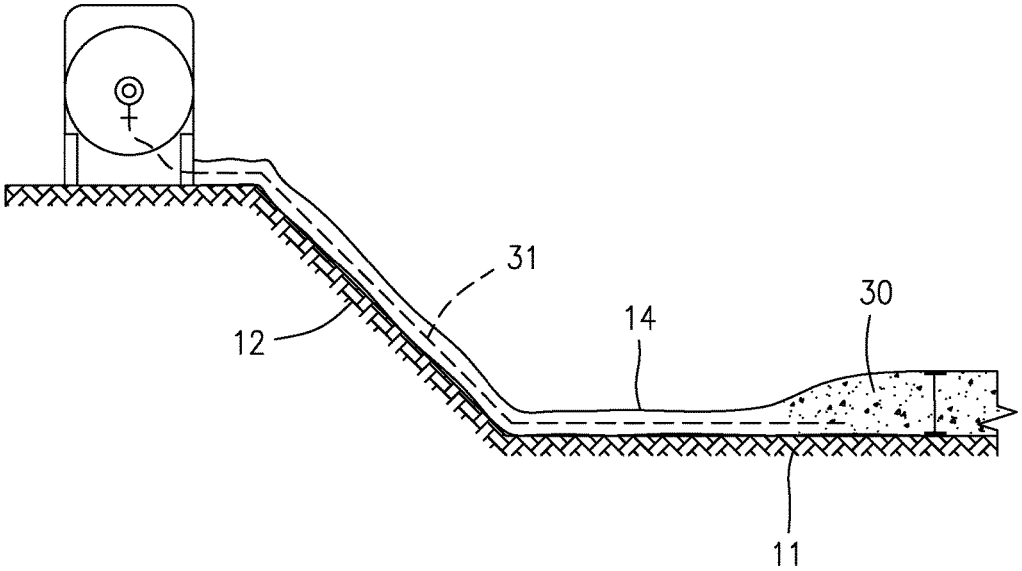
FIG. 8 is an enlarged detail of FIG. 7 that shows the step of supplying the cementitious mixture of permanent ballast to a waterproof panel according to FIG. 3.

The above has been shown schematically in the embodiment of FIGS. 7 and 8 for the panel of FIG. 3. As previously mentioned, after checking and possibly reprofiling the entire area of the canal, or water basin to be waterproofed, and after preparing the waterproof panels 14 in the factory, rolling the panels 14 up into the rolls already provided with the sealing flaps 26 provided with zip fasteners 18, and with anchor bands 23, in which the panels 14 have a width that is suitable for covering the entire cross section of the canal or water basin, the panels 14 are conveyed to the laying site.

Then the panels in rolls are loaded onto a boat, where they are positioned individually on special equipment for laying both dry and for laying underwater on the bottom and/or on the banks of a canal or water basin.

The panels 14 are then laid in sequence, being unrolled progressively from one bank of the canal or water basin 10, as indicated in FIG. 7, where one end 14' thereof (FIG. 1), is fixed to the ground, above the level of the water, by means of anchor stakes 15.

Each panel 14 is then immersed in water and unrolled continuously from one bank 12, on the bottom 11 of the canal or water basin, as far as the opposite bank 12, as indicated schematically in FIG. 7, where the other end of the panel 14 is again fixed by means of stakes or anchoring 15.

During unrolling and laying of each panel 14, one or both the anchor bands 23 are fixed beforehand to the banks 12 and to the bottom 11 by means of stakes or anchoring 15, in particular, to the top band, as shown in FIG. 4, to prevent the flow of water or possible wave movements being able to move the panel, misaligning the side edge thereof and the sealing flap 26 with respect to the edge and to the sealing flap 26 of a previously spread adjoining panel 14.

After spreading and anchoring a panel 14 by the stakes 15 between the two banks 12, in the same manner another panel 14 that adjoins the preceding panel is unrolled and spread; whilst each panel 14 is unrolled underwater, the waterproof zip fastener 28 is simultaneously and progressively closed, coupling the two opposite toothed strips 28.1 and 28.2 of two adjoining panels 14. Possible misalignments of the panels 14 are compensated by the slack of the two sealing flaps 26, permitting anyway closure of the zip fastener 28 and consequently a waterproof closure; the same procedure can be followed if necessary for dry laying.

After spreading each panel 14 by provisionally fixing each panel 14 with the anchoring elements 15, the panel 14 is permanently anchored to the banks 12 and to the bottom 11 by a ballast that is suitable for pressing the lower membrane 16 against the banks 12 and the bottom 11 of the canal or water basin, where it is firmly frictionally retained against the ground by the possible rear textile layer 19.

In particular, in the case of the panel 14 of FIG. 3, as indicated schematically in FIG. 8, after laying of the panel, the chamber 18 is filled with a fluid ballast that is able to solidify over a time that is comparatively longer than that of the laying and sealingly connecting the individual panels.

The ballast can consist of a fluid mixture of cementitious material, of a mass of sand particles, gravel of suitable granulometry or other material, with possible additives and binders, the ballast being pumped from a concrete mixer or storage tank configured for being moved along one or both banks 12.

The ballast that is suitable for being injected into the panels 14 can be made in any manner; during some tests good results were obtained using a fluid ballast having the following percentage composition:

water 12-18%
cement 12-18%
fine sand 50-70% having a granulometry that is the same as or less than 3 mm
inert load 6-20%
fluidifying additive 1-6 lt/m3
retardant additive 0.5-2 lt/m3
modifying viscosity additive 0.5-3 lt/m3.

The cementitious mixture obtained, depending on the percentages of the various components, had after hardening a weight comprised between 1.8 and 2.2 t/m3.

Obviously the ballast to be injected into the individual panels 14 can be made in any manner, using sand or another inert material locatable in the place.

The panel 14 can be filled with ballast in any manner, for example by pumping the fluid ballast 30 into the panel 12 at a pressure that is suitable for overcoming the pressure of the surrounding water, in such a manner that the panel 14 swells gradually to take on a flat shape permitted by the inner tie rods 22 that connect the lower membrane 16 to the upper membrane 17.

Figure 9:
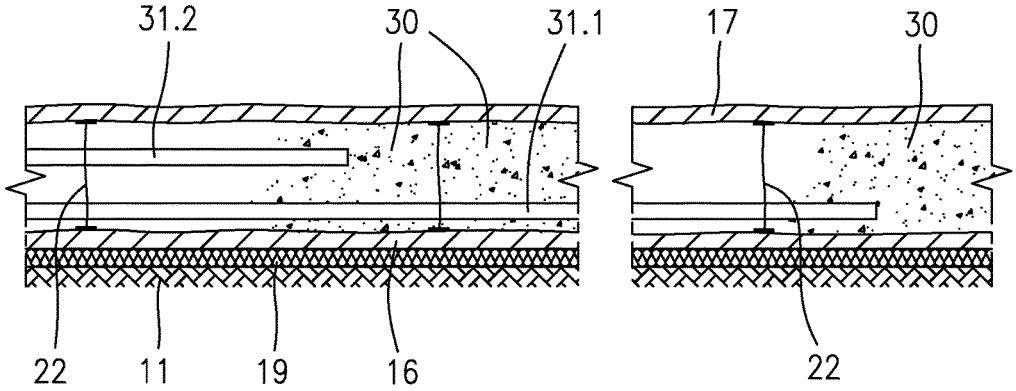
FIG. 9 shows an enlarged detail of FIG. 8.

Depending on the features of the waterproof panels 14, the waterproof panels 14 can be filled with ballast in fluid state from one or both ends of the panel, supplying the fluid ballast 30 for example by a flexible pipe 31, as indicated schematically in FIG. 8. The filling of the panel 14 with ballast 30 can be made from the centre of the panel, by progressively moving the flexible pipe 31 as far as the top of the corresponding bank 12. Alternatively, the pipe 31 can be left permanently in the panel 14, being included in the fluid mass that is subsequently solidified by the ballast 30. It is also possible to proceed as shown schematically in FIG. 9, by providing two or more pipes 31.1, 31.2 of different length, to supply dosed quantities of fluid ballast 30 to different zones of the panel 14, so as to obtain complete and homogenous filling.

Although a homogeneous distribution of the ballast 30 is advisable, this distribution and the quality of the ballast or of the mixture of components used are not essential for the purposes of waterproof. In fact, unlike the bentonite waterproof panels proposed previously in which waterproof was due only or mainly to the thickness of the layer of bentonite or to the special bentonite mixture used, in the case of the present invention the ballast 30 has only the function of firmly frictionally anchoring the panel 14 to the banks 12 and to the bottom 11 of the canal or water basin, as waterproof is provided only by the synthetic material of the membranes 16 and/or 17, in combination with the zip fasteners 28 between adjoining panels 14.

It is lastly pointed out that a possible ballast 32, consisting of a concrete beam, can be superimposed on the watertight joints 28 between panels 14, as indicated schematically in FIG. 4.

In the preceding embodiment, the waterproof panel 14 is filled with fluid ballast 30, the ballast being supplied from one or both ends of the panel 14, for example by means of one or more flexible pipes 31 inserted through the open ends of the panel 14, or through suitable openings if the ends of the prefabricated panel are sealingly closed, providing in this case suitable openings or venting valves for the air inside the panel 14.

Figure 10:
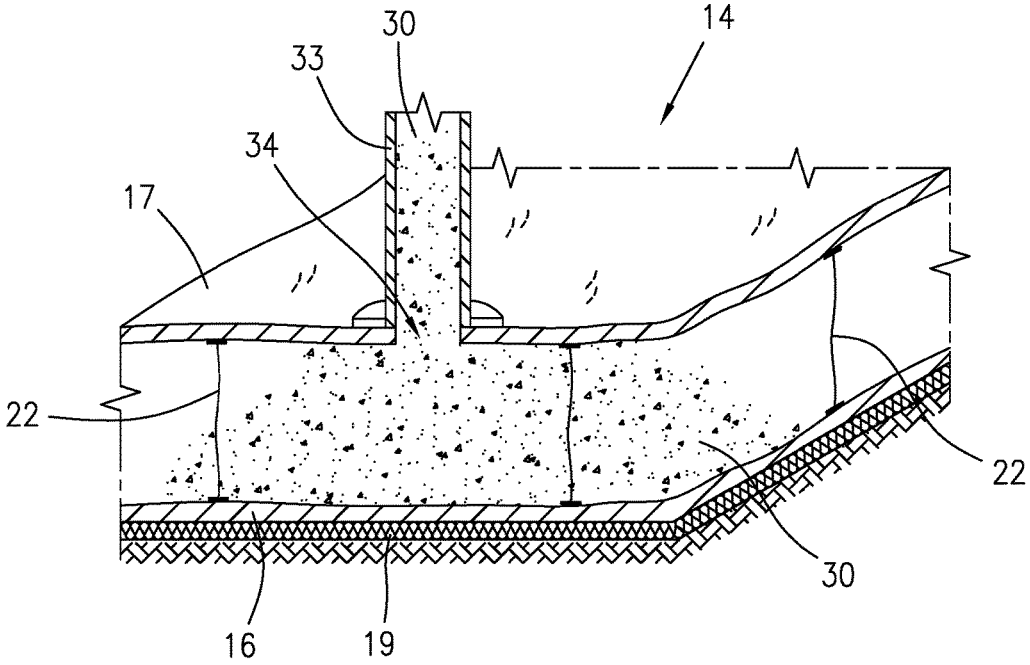
FIG. 10 shows a version for supplying a ballast cementitious mixture to the panel of FIG. 3.

Alternatively to the previously disclosed solution, the ballast 30 in fluid state can be supplied to the panel 14 at one or more points, via a respective flexible pipe 33, as indicated schematically in FIG. 10, at a respective opening 34 in the upper waterproof sheet 17; in the case of panels 14 of large dimensions, it will be necessary to use a plurality of feeding pipes 33 that are suitably positioned and connected to the upper membrane 17 during prefabrication of the panel; once filling of the panel 14 with ballast 30 has been completed, the flexible pipe 33 can be cut.

With regard to the embodiment of the panel 14 of FIG. 3, it has been said that the lower waterproof membrane 16 and the upper waterproof membrane 17 define a single tubular chamber 18 that is totally filled with ballast 30; alternatively to the single tubular chamber 18 of the embodiment of FIG. 3 it is possible to divide the inner space of the panel, into a plurality of tubular chambers or separate cells, or into a plurality of variously configured cells that communicate between one another.

Figure 11:
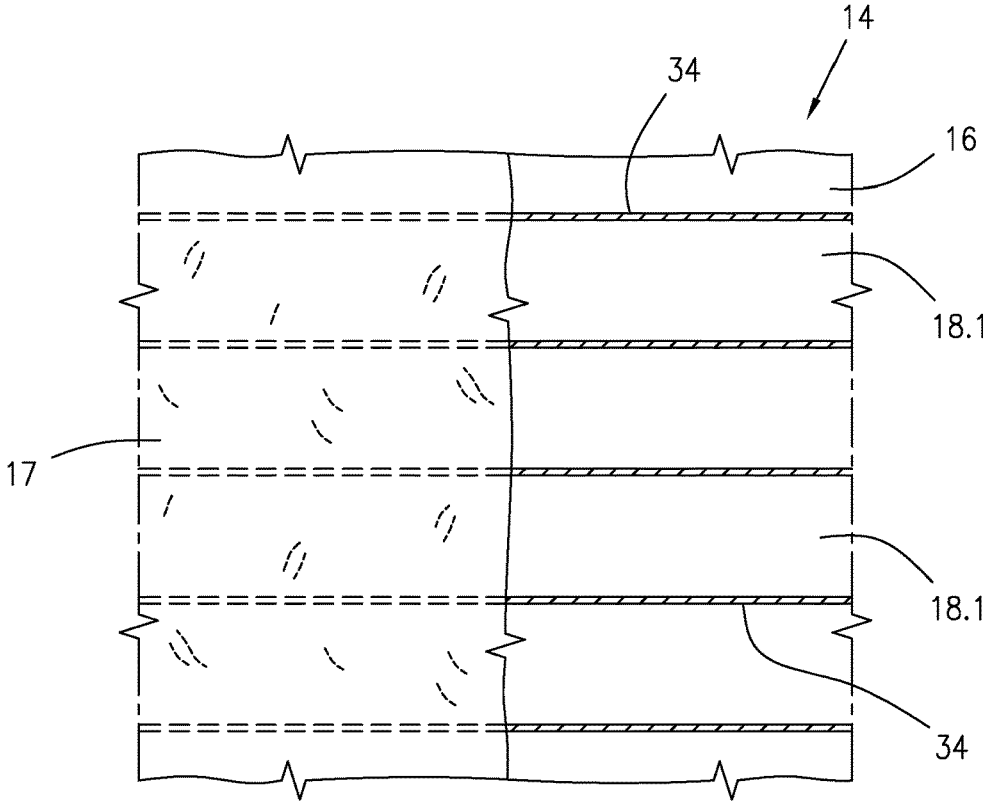
FIG. 11 shows, schematically, a second embodiment of a waterproof panel.

For example, as shown in the detail of FIG. 11, the inner space of the panel 14 confined between the lower waterproof membrane 16 and the upper waterproof membrane 17, has been divided into a plurality of tubular cells 18.1 that extend in the longitudinal direction of the panel, being separated from one another by adjoining inner baffles 34; in this case the various tubular cells 18.1 have to be filled individually with fluid ballast 30, for example by respective feeding pipes 31, or in another manner.

Figure 12:
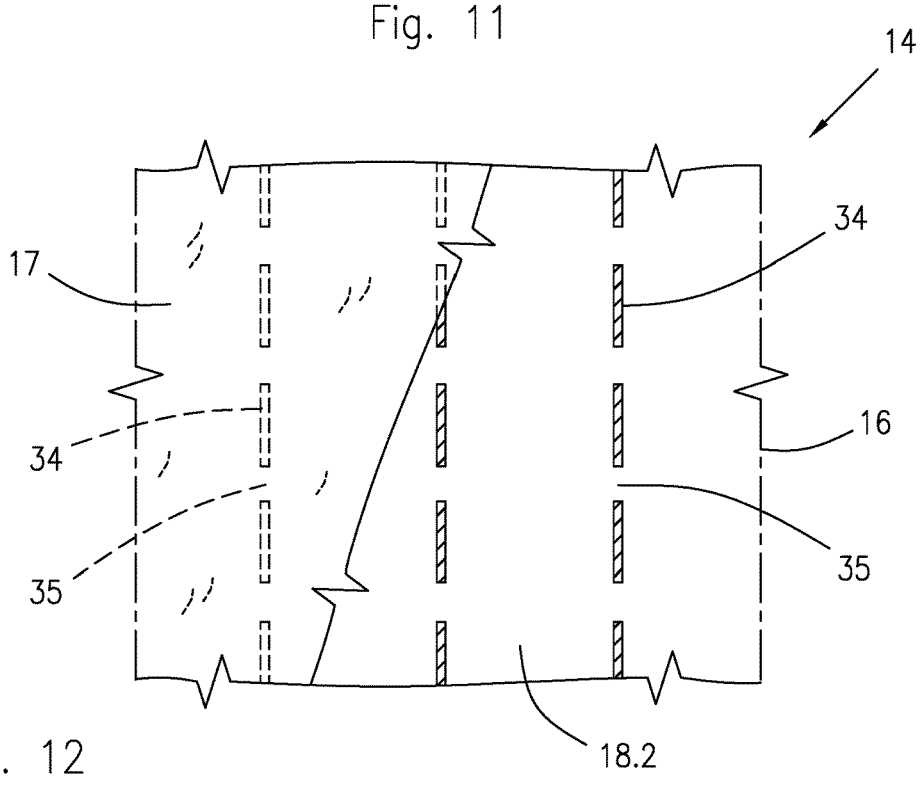
FIG. 12 shows, schematically, a third embodiment of a waterproof panel.

Alternatively to the solutions of FIGS. 3 and 11, it is possible to adopt the solution of FIG. 12; in this case use is made of tubular cells 18.2 that are interconnected through wide openings 35 in the inner baffles 34 that divide longitudinally, or transversely, every single panel 14. In both the cases of FIGS. 11 and 12 the inner baffles 34 that bound laterally every single tubular cell also perform the function of the inner tie rods 22 disclosed previously.

Figure 13:
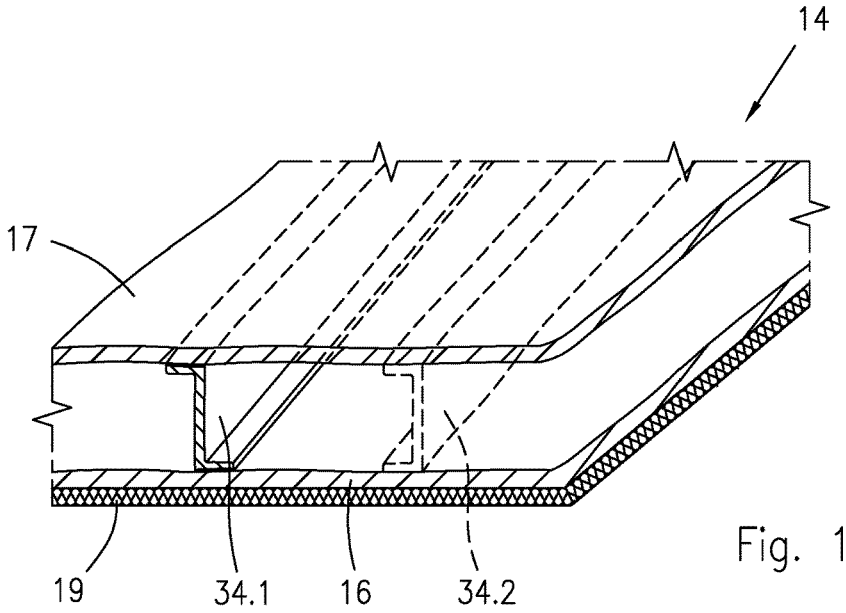
FIG. 13 shows two possible versions of the connecting tie rods between the lower waterproof membrane and the upper waterproof membrane of the panel of FIG. 3.

The inner baffles 34, or equivalent tie rods, could be configured differently, as shown in the two embodiments of FIG. 13; in particular, on the left side an inner baffle or tie rod 34.1 is shown that is obtained from a strip of plastics made of synthetic resin that is compatible with that of the lower membrane 16 and upper membrane 17.

In the case of the left baffle or spacer 34.1, the baffle has been obtained by folding into a Z shape the two longitudinal edges that are welded to the waterproof membranes 16 and 17 during the step of prefabricating the panel; otherwise, in the case of the right baffle 34.2, the latter is obtained by folding the longitudinal edges into a C shape.

Figure 14:
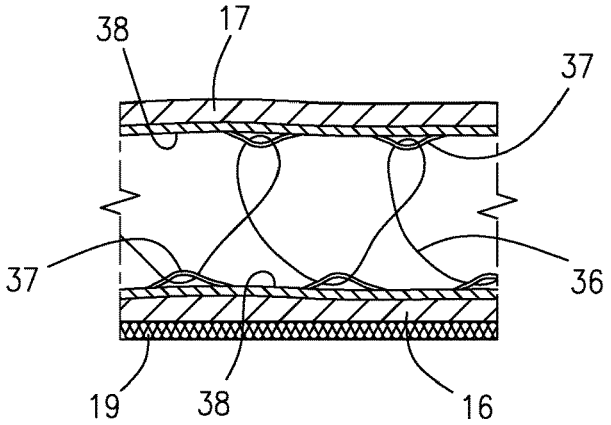
FIGS. 14 and 15 show two further possible versions of the tie rods for the panel of FIG. 3.

The FIG. 14 shows a further solution; in this case the tie rods consist of cords 36 made of synthetic fibres, that are alternatively threaded into slots 37 fixed to a textile web 38 welded to the inner side of the lower waterproof membrane 16 and of the upper waterproof membrane 17; during some tests, this solution proved to be extremely suitable because it enabled a test panel to be filled with ballast extremely quickly.

Figure 15:
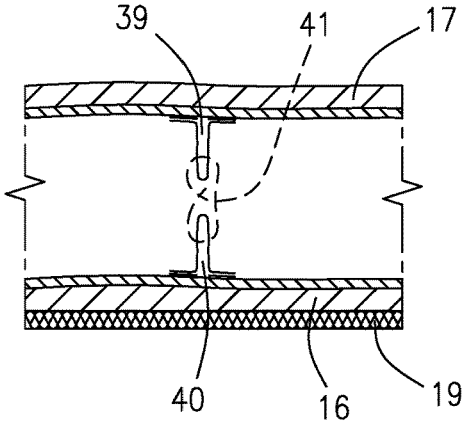

The FIG. 15 shows another solution in which the tie rods consist of two textile bands 39 and 40 folded into a U shape, which are welded to the two waterproof membranes 16, 17, that extend longitudinally to the waterproof panel; the two bands 39, 40 are connected together, for example, by a plurality of hooks 41 placed at preset distances.

Figure 16:
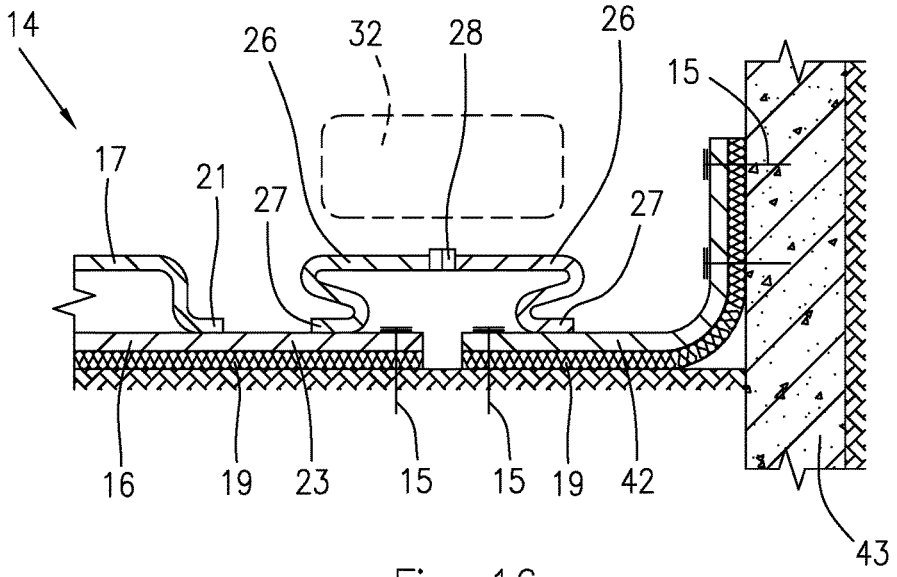
FIG. 16 shows a system for anchoring a panel to a concrete structure.

The use of the waterproof panels according to the invention, in addition to forming a waterproof liner having the disclosed features, also permits mechanical sealing anchoring of the individual panels 14 at the banks and/or concrete structures; this is shown for example in FIG. 16, where part of a panel 14 has been shown that is similar to that of FIG. 4, in which one edge 23 of the panel is sealingly connected mechanically to a concrete structural element 43, by means of a band 42 and a watertight joint 26, 28 of the disclosed type.

Figure 17:
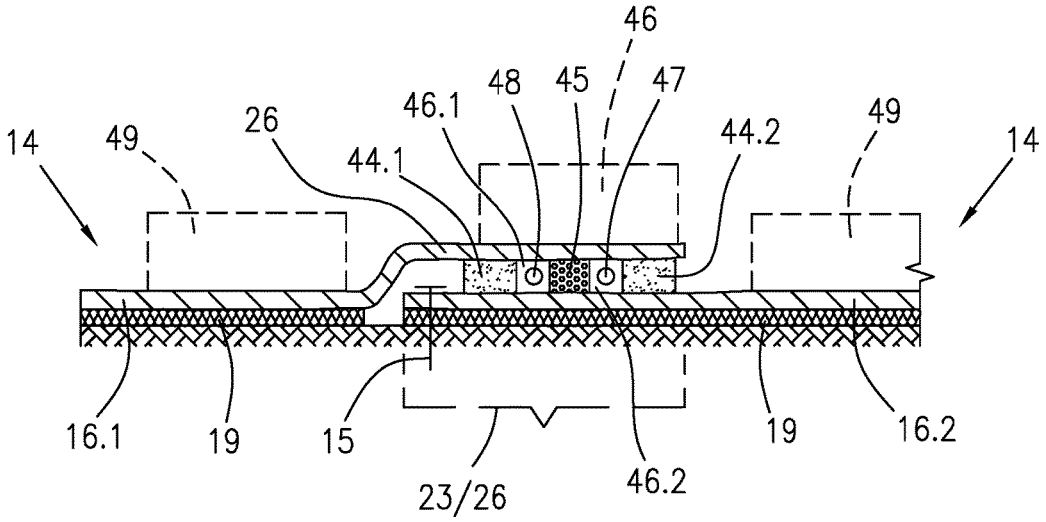
FIG. 17 shows an enlarged detail of a further embodiment of the waterproof panel and of the watertight joint according to the invention.

FIG. 17 shows a further solution for the waterproof panel 14, which is also suitable for installation and laying underwater in canals or water basins according to the present invention; in particular, FIG. 17 shows part of two adjoining panels and a different configuration of the intermediate watertight joint.

In the case of FIG. 17 each waterproof panel 14 substantially consists of only the waterproof membrane 16, again consisting of a geomembrane having a low permeability coefficient K, as previously defined, comprising a rear protective layer 19 consisting for example of a technical textile or geotextile that is suitable for protecting the waterproof membrane 16 from possible perforations caused by the underlying ground, and suitable for providing the friction necessary for immobilising the panel 14 after it has been ballasted.

The solution of FIG. 17 differs from the preceding one inasmuch as each waterproof membrane 16 extends on one side of the panel with a first band or flap 23/26 that is suitable for performing both a preliminary function of anchoring the panel during laying, by stakes 15 as in the preceding function, and a complementary sealing function with an opposite flap 26 of an adjoining panel; in fact, on the longitudinal side opposite the preceding one, as shown for the left panel 14 the waterproof membrane 16 extends with a second sealing flap 26. Thus, during laying of the panels, the second sealing flap 26 of each panel 14, is superimposed on the first sealing and anchoring band or flap 23/26 of the right panel, interposing between the two superimposed flaps 26 a compression sealing device, as shown schematically.

In particular, in the embodiment of FIG. 17 the compression sealing device comprises two spongy bands 44.1, 44.2 that are suitable for being impregnated with water during laying of the panels, and an intermediate band 45 consisting of a textile containing bentonite in powder form; superimposing on the thus formed joint a ballast 46, for example a concrete beam, the water contained in the two side spongy bands 44 wets the bentonite of the central watertight band 45, which thus tends to expand; as the expansion of the bentonite is prevented by the ballast 46, consequently the central band 45 adheres in a watertight manner to the flaps 26 of the two panels 14, providing the necessary seal. The two side spongy members 44.1 and 44.2 are spaced apart from the central band 45, forming two longitudinal chambers 46.1 and 46.2, into which a tubular element 47 and 48 can be inserted, one of which, for example the tubular element 47, is used to monitor possible leaks of the joint through the water that can exit from the tubular element, whilst the other tubular element 48, in the case of loss of watertightness of the joint, can be used to inject bentonite or another sealing material to restore the watertightness of the joint.

In this case the panels 14, unlike the panel of FIG. 3, can be ballasted with a plurality of concrete blocks or beams 49, or in any other manner.

Figure 18:
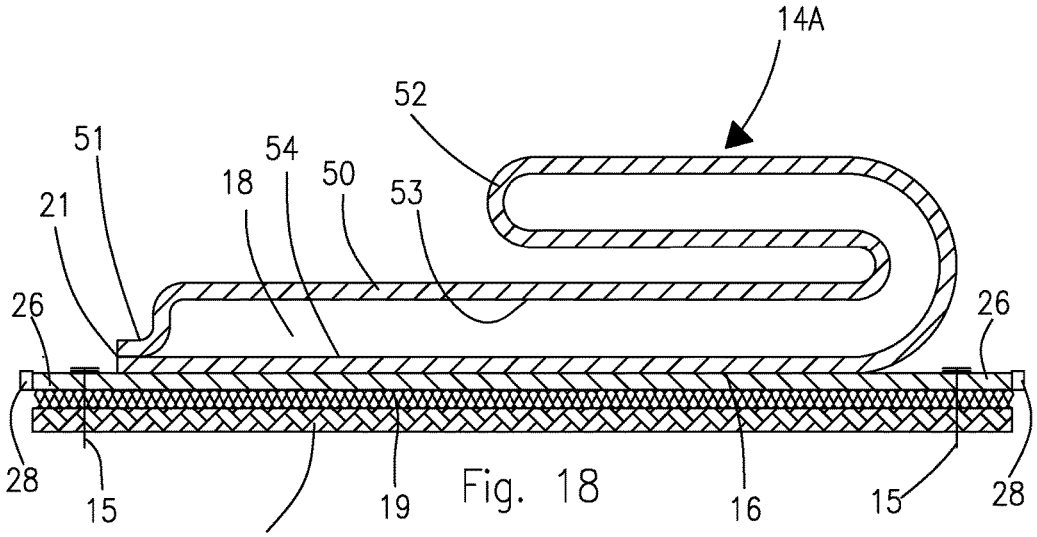
FIGS. 18 to 20 show a still further embodiment of a waterproof panel according to the invention.
Figure 19:
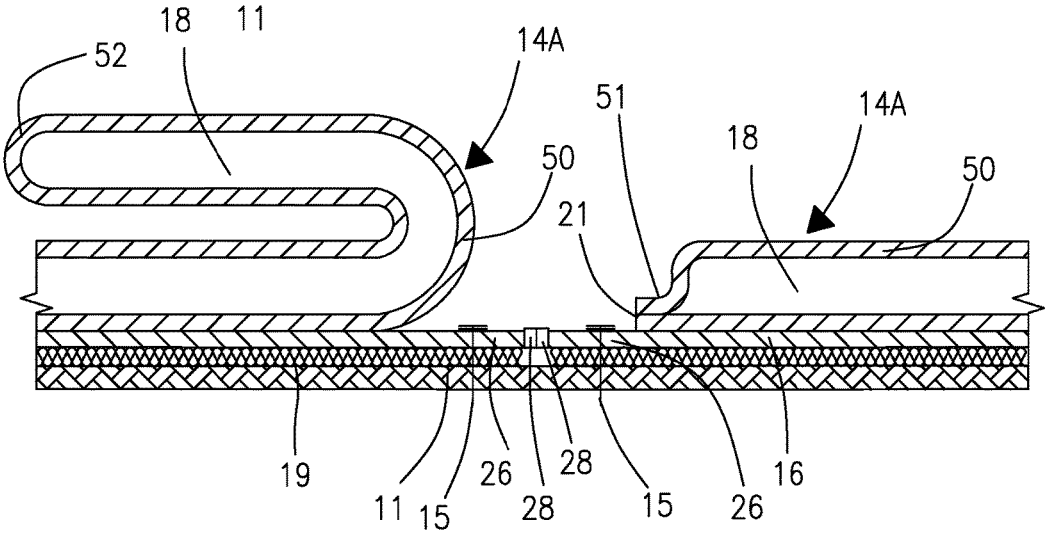
Figure 20:
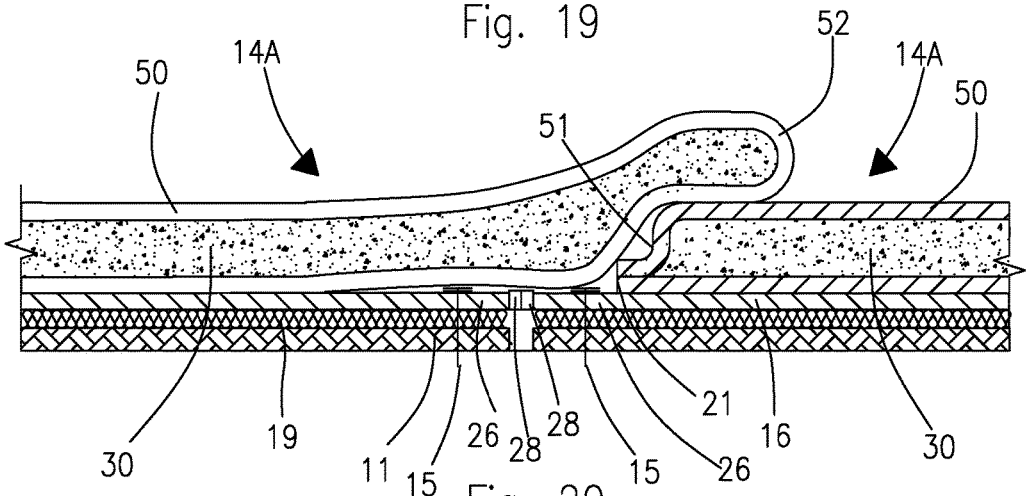

FIGS. 18 to 20 show a still further solution for the waterproofing panel, denoted as a whole with the reference numeral 14A, which is also suitable for installation and laying underwater in canals or water basins of a waterproofing liner according to the present invention.

In particular, FIG. 18 shows a cross section of the panel 14A, whilst FIGS. 19 and 20 show portions of two adjacent panels 14A in two subsequent installation steps.

The panel 14A comprises a first waterproof membrane 16 made of a geosynthetic material, to be laid on the bottom 11, or on the side banks 12, of a channel or water basin 10, provided with flexible anchor and sealing flaps 26, each of which is configured with a toothed strip 28 which is part of a waterproof zip fastener. The panel 14A further comprise a second waterproof membrane 50, folded in a tubular shape, with its lateral edges joined in a watertight fashion at a first end 51 along a welding line 21, in such a way as to define inside the panel 14A a tubular chamber 18 of any desired length and width.

The second waterproof membrane 50 is laid upon and welded to the first impermeable membrane 16 and extends longitudinally between the flexible flaps 26. The flexible flaps 26 are used both for a preliminary anchoring of the panels 14A, for example by means of stakes 15, during laying underwater and for connecting together two adjacent panels 14A in a watertight fashion. The flexible flaps 26 extends along lateral edges of the panel 14A and can be shaped in any manner; for instance, in the case shown, they consist of an extension of the lateral edges of the first membrane 16 beyond the end of the second membrane 50, for a pre-established length. The flexible flaps 26 may be provided with a series of holes for the insertion of the anchor stakes.

Inside the tubular chamber 18 the flexible inner tie rods 22, 34, 36, 39, 40 previously described may be provided, to keep opposite inner walls 53, 54 of the tubular chamber 18 at a pre-established distance during injection of the ballast 30.

FIGS. 19 and 20 show the installation of adjacent panels 14A.

First of all, the flexible flaps 26 at the ends of two panels 14A are anchored, for instance, to the bottom 11 of the channel by means of respective stakes 15. While the flexible flaps 26 are anchored, a second end 52 of the second tubular membrane 50, opposite the first end 51, is kept folded back, as shown in FIG. 19, so that it does not interfere with the anchoring operation of the panels 14A.

When the flexible flaps have been anchored, the second end 52 of each panel 14A is laid on the adjacent panel 14A, as shown in FIG. 20. The tubular chambers 18 of each panel 14A are filled with a ballast material, as previously described.

Figure 21:
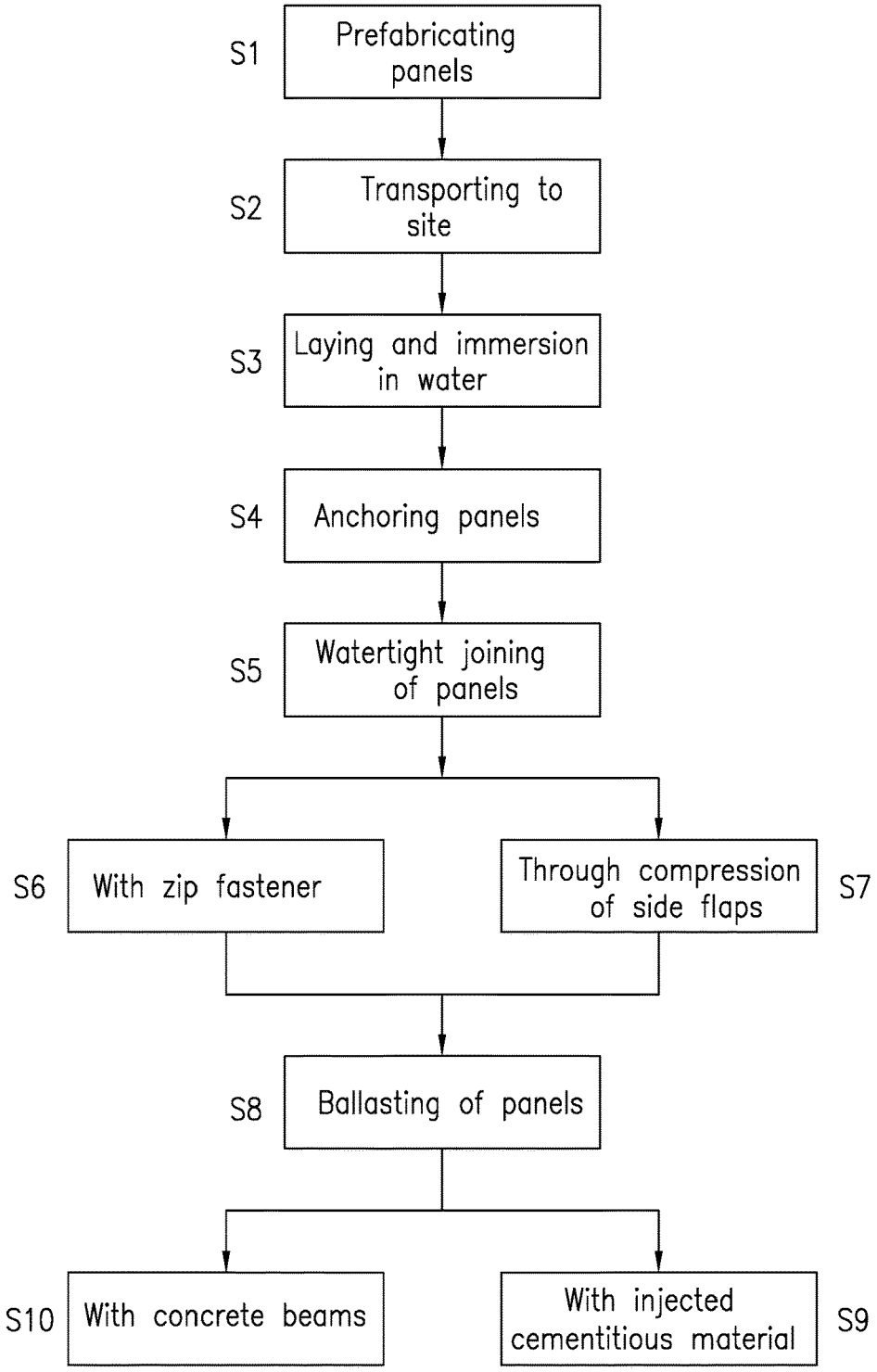
FIG. 21 is a flow diagram of a method for laying the panels, in the installation of a waterproof liner according to the invention.

With reference now to the flow diagram of FIG. 21, the essential steps S1-S10 of the method of installing and laying the waterproof panels 14 will be disclosed briefly, so as to form a waterproof liner in canals and water basins, characterised by the continuity and homogeneity of the waterproof over the entire area to be covered, and the structural and functional independence of the individual panels 14.

As previously mentioned, the panels 14 are suitably prefabricated, in all parts, including the zip fasteners or equivalent watertight parts, step S1.

Once completed, the panels 14 are rolled up into rolls and conveyed to the laying site, step S2; at this point the individual panels can be sequentially unrolled and immersed underwater, step S3, or be laid dry using the laying methodology mentioned previously. During laying, each panel 14 is anchored along one or both bands 23, for example the top band in the case of flowing water, by means of stakes 15, step S4, taking care to keep the opposite anchor bands 23 of two adjoining panels 14 parallel or aligned or superimposed. During laying of the individual panels 14, the individual panels 14 are watertight jointed, step S5, operating according to the type of joint used, with a watertight zip fastener 28, step S6, or through compression of the side bands 23, step S7; if the waterproof joint consists of a zip fastener 28, for example of the type illustrated in FIGS. 5 and 6, the gradual watertight closing of the zip fastener 28 between two adjoining panels 14 is performed automatically with unrolling and laying of each panel.

After the adjoining panels have been watertight jointed, every single panel is ballasted, step S8, through the injection of a fluid ballast made of cementitious material, step S9, by pumping the fluid ballast into the chambers or into the cells of the panel as disclosed previously, step S9, or by superimposing on the panel 14 concrete beams, step S10.

The operations of laying, watertight jointing and ballasting the panels are thus continued until the installation and laying underwater, with the disclosed methods, of a waterproof liner for the entire area of the canal or water basin to be covered.

From what has been said and shown in the embodiments of the attached drawings, it will be clear that a method has been provided for installing underwater a waterproof liner on the banks and on the bottom of hydraulic canals, canals for irrigation and in basins for collecting water, in which use is made of the prefabricated waterproof panels, and of a watertight jointing device between adjoining panels that is configured with anchor and watertight flaps that are suitable for permitting the operations of watertight jointing underwater during the step of immersing and spreading the individual panels; a waterproof panel has also been provided that is suitable for laying underwater and watertight jointing with other panels in the installation of waterproof liners in the presence of water, in which the waterproof liner and the panels have the disclosed features.

The invention claimed is:

1. A method for installation and laying of a waterproof liner on the bottom and side banks of a canal or water basin, wherein the waterproof liner comprises a plurality of waterproof tubular panels anchored to the bottom or side banks of the canal or basin, each panel comprising at least a waterproof membrane, wherein said plurality of waterproof tubular panels are separate units from each other, wherein the method comprises the following steps:

manufacturing the plurality of waterproof tubular panels in which each of the plurality of waterproof tubular panels comprises at least a tubular ballast chamber and flexible sealing flaps extending longitudinally along opposite side edges of each waterproof tubular panel;

sequentially positioning a number of the plurality of waterproof tubular panels on the bottom and/or on the side banks of the canal or water basin;

fastening in advance each waterproof tubular panel to the bottom and/or to the side banks of the canal or water basin during laying;

joining said waterproof tubular panels side by side through said flaps by removably connecting, in a sealing fashion, distal ends of opposite flexible sealing flaps of adjoining waterproof tubular panels by an intermediate watertight connecting device, during laying of the waterproof tubular panels; and ballasting and frictionally anchoring each waterproof tubular panel to the bottom and/or to the side banks of the canal or water basin by injecting a concrete mixture in the tubular ballast chamber after each panel has been laid.

2. The method for installation and laying down of a waterproof liner according to claim 1, comprising performing the fastening step of each waterproof tubular panel, and a watertight connection of the intermediate watertight connecting device during underwater laying of each waterproof tubular panel into the canal or water basin.

3. The method for installation and laying of a waterproof liner according to claim 1, comprising connecting the distal ends of the opposite flexible sealing flaps of adjoining waterproof tubular panels by a watertight zip fastener.

4. The method for installation and laying of a waterproof liner according to claim 3, comprising closing the watertight zip fastener connecting adjoining waterproof tubular panels simultaneously with the fastening to the bottom and/or side banks of side anchor bands, or of the flexible sealing flaps, during underwater laying of the waterproof tubular panels.

5. The method for installation and laying of a waterproof liner according to claim 1, comprising configuring the intermediate watertight connecting device between waterproof tubular panels, with opposite overlapped flexible sealing flaps of adjoining waterproof tubular panels, and positioning an expandable sealing element between the overlapped flaps pressing the expandable sealing element by a ballast member.

6. The method for installation and laying of a waterproof liner according to claim 1, comprising configuring each waterproof tubular panel with at least one tubular chamber or a plurality of cells in which a ballast is injected consisting of a concrete mixture at a fluid state.

7. The method for installation and laying of a waterproof liner according to claim 6, comprising injecting the ballast material from at least one end or from at least one internal zone of the waterproof tubular panel.

8. The method for installation and laying of a waterproof liner according to claim 7, comprising injecting the ballast material by one or more tubular members which extend into the tubular chamber or the plurality of cells towards different internal zones of the waterproof tubular panel.

9. The method for installation and laying of a waterproof liner according to claim 1, comprising configuring the waterproof tubular panel with a bottom waterproof membrane and an upper waterproof membrane sealingly connected along peripheral edges, in which at least one of the waterproof membranes is made of a geosynthetic material.

10. The method for installation and laying of a waterproof liner according to claim 1, comprising configuring the waterproof tubular panel with a first waterproof membrane made of a geosynthetic material and a second waterproof membrane, folded in a tubular shape, side edges of said second waterproof membrane being sealingly joined along a sealing line, at a first end, said second waterproof membrane being superimposed and welded to the first waterproof membrane, the tubular ballast chamber being defined inside the second waterproof membrane.

11. The method for installation and laying of a waterproof liner according to claim 6, comprising injecting the ballast material into the tubular chamber or cells of the waterproof tubular panel, by flexible feeding conduits connected to openings of the upper waterproof membrane, or of the second waterproof membrane.

12. The method for installation and laying of a waterproof liner according to claim 1, comprising providing a watertight connection device between the distal ends of the flexible sealing flaps of adjoining waterproof tubular panels, wherein each waterproof tubular panel consists of a single waterproof membrane in geosynthetic material.

13. The method for installation and laying of a waterproof liner according to claim 1, comprising providing a watertight connection device between the distal ends of the flexible sealing flaps of adjoining waterproof tubular panels, wherein each waterproof tubular panel consists of a first waterproof membrane in geosynthetic material and a second waterproof membrane folded in a tubular shape.

14. The method for installation and laying of a waterproof liner according to claim 1, wherein the waterproof tubular panel comprises a bottom waterproof membrane and an upper waterproof membrane providing one or more tubular ballast chambers or cells for a permanent ballast material, comprising the step of providing a plurality of flexible inner tie members configured to maintain at a prefixed space the bottom waterproof membrane and the upper waterproof membrane during injection of the ballast material.

15. The method for installation and laying of a waterproof liner according to claim 1, comprising the step of providing inside the tubular ballast chamber a plurality of flexible inner tie members configured to maintain opposite inner walls of the tubular ballast chamber at a prefixed distance during injection of the ballast material.

16. The method for installation and laying of a waterproof liner according to claim 9, comprising configuring at least one of the bottom waterproof membrane and the upper waterproof membrane with synthetic material having a permeability coefficient K equal to or lower than 10<−10> cm/s.

17. The method for installation and laying of a waterproof liner according to claim 10, comprising configuring at least one of the first waterproof membrane and the second waterproof membrane with synthetic material having a permeability coefficient K equal to or lower than 10<−10> cm/s.

18. A waterproof liner for a canal or water basin suitable to be installed and laid down, wherein the liner comprises:

a plurality of side by side arranged waterproof tubular panels which extend on a bottom and side banks of the canal or water basin, wherein each waterproof tubular panel comprises at least a waterproof membrane and is configured with at least a ballast chamber and wherein each waterproof tubular panel is provided with flexible flaps which extend longitudinally along opposite side edges of the waterproof tubular panel;

an intermediate watertight connecting device between distal ends of opposite flexible sealing flaps of waterproof tubular panels facing each other;

each waterproof tubular panel comprising at least an opening for injecting cementitious mixture for ballasting and frictionally anchoring each waterproof tubular panel to the bottom or the side banks of the canal or water basin;

wherein each waterproof tubular panel is provided with flexible anchor bands, wherein at least one flexible anchor band of each waterproof tubular panel is fixed to the bottom or the side banks of the canal or water basin.

19. The waterproof liner according to claim 18, wherein at least one flexible sealing flap of each panel is fixed to the bottom or the side banks of the canal or water basin.

20. The waterproof liner according to claim 18, wherein the intermediate watertight connecting device between the distal ends of flexible sealing flaps comprises a watertight zip fastener.

21. The waterproof liner according to claim 18, wherein the flexible sealing flaps of adjoining waterproof tubular panels are connected to each other in a slack manner.

22. The waterproof liner according to claim 18, wherein the intermediate watertight connecting device between the distal ends of the flexible sealing flaps comprises an expandable watertight member positioned between overlapped flexible sealing flaps, and a permanent ballast positioned to press said expandable watertight member between the overlapped sealing flaps.

23. The waterproof liner according to claim 22, wherein the expandable watertight device comprises a material which expands in contact with water.

24. The waterproof liner according to claim 23, wherein the expandable watertight device is positioned between two side spongy members.

25. The waterproof liner according to claim 24, comprising a first water leakage detecting chamber, respectively a second chamber for injecting a sealing-material, said first and second chamber being disposed between the expandable watertight member and the side spongy members.

26. A waterproof panel suitable for installation and laying of a waterproof liner for canals and water basins according to claim 18, wherein the waterproof panel is configured as a tubular panel comprising:

at least one waterproof membrane made of geosynthetic material, having side edges extending in a longitudinal direction of the waterproof panel;

a flexible sealing flap along opposite side edges of the waterproof panel;

wherein the distal end of each sealing flap of a waterproof panel is connectable to the distal end of a sealing flap of another waterproof panel by means of an intermediate watertight connecting device.

27. The waterproof panel according to claim 26, comprising a bottom waterproof membrane and an upper waterproof membrane sealingly welded along peripheral edges, and a plurality of flexible internal tie members between the bottom membrane and the upper membrane.

28. The waterproof panel according to claim 26, comprising a first waterproof membrane and a second waterproof membrane, folded in a tubular shape, having superimposed side edges sealingly joined along a sealing line, said second waterproof membrane being superimposed and welded to the first waterproof membrane, at least one tubular chamber, having opposite inner surfaces, being defined inside the second waterproof membrane, a plurality of flexible internal tie members being provided between opposite inner surfaces of the tubular chamber.

29. The waterproof panel according to claim 27, wherein at least one of the waterproof membranes is made of a geosynthetic material.

30. The waterproof panel according to claim 27, wherein the internal tie members comprise a plurality of eyelets on an inner side of each bottom and upper waterproof membrane and a plurality of cord members alternately threaded in the eyelets of the upper waterproof membrane and the bottom waterproof membrane of the waterproof panel.

31. The waterproof panel according to claim 28, wherein the internal tie members comprise a plurality of eyelets on each inner wall of the tubular chamber and a plurality of cord members alternately threaded in the eyelets of inner walls of the tubular chamber.

32. The waterproof panel according to claim 26, wherein each sealing flap is provided with a toothed strip constituting part of a watertight zip fastener.

* * * * *